US010989437B1

(12) United States Patent
Dolan

(10) Patent No.: US 10,989,437 B1
(45) Date of Patent: Apr. 27, 2021

(54) INSECT BARRIERS FOR INLETS AND VENTS

(71) Applicant: John T. Dolan, Allison Park, PA (US)

(72) Inventor: John T. Dolan, Allison Park, PA (US)

( * ) Notice: Subject to any disclaimer, the term of this patent is extended or adjusted under 35 U.S.C. 154(b) by 0 days.

(21) Appl. No.: 17/127,028

(22) Filed: Dec. 18, 2020

Related U.S. Application Data

(63) Continuation of application No. 16/577,064, filed on Sep. 20, 2019, which is a continuation of application No. 14/738,059, filed on Jun. 12, 2015, now abandoned.

(60) Provisional application No. 62/011,772, filed on Jun. 13, 2014.

(51) Int. Cl.
*F24F 13/08* (2006.01)

(52) U.S. Cl.
CPC ..... *F24F 13/082* (2013.01)

(58) Field of Classification Search
CPC ..... F24F 13/082
USPC ..... 454/276
See application file for complete search history.

(56) References Cited

U.S. PATENT DOCUMENTS

| | | | | |
|---|---|---|---|---|
| 770,019 | A | 9/1904 | Neireiter | |
| 853,598 | A | 5/1907 | Rile | |
| 2,239,255 | A | 4/1941 | Shaw | |
| 2,513,056 | A | 6/1950 | Scallon | |
| 2,804,006 | A | 8/1957 | Shatkin | |
| 3,382,860 | A | 5/1968 | Cooper | |
| 3,515,305 | A | 6/1970 | Weber | |
| 3,517,813 | A | 6/1970 | Thaler | |
| 3,727,539 | A | 4/1973 | Wilmes | |
| 4,159,673 | A | 7/1979 | Weirich | |
| 4,418,719 | A | 12/1983 | Downs, Jr. | |
| 5,167,104 | A | 12/1992 | Alvarado | |
| D336,952 | S | 6/1993 | Raneo | |
| 5,291,707 | A | 3/1994 | McDonald | |
| 5,297,895 | A | 3/1994 | Johnson | |
| 5,341,767 | A * | 8/1994 | Smith | F23C 7/00 122/13.01 |
| 5,427,417 | A | 6/1995 | Lechuga | |
| 5,547,422 | A | 8/1996 | Seboldt | |
| D390,948 | S | 2/1998 | Meyer | |
| D397,431 | S | 8/1998 | Meyer | |
| 6,125,839 | A | 10/2000 | Elgowainy | |
| 6,360,493 | B1 | 3/2002 | Torres, III | |

(Continued)

FOREIGN PATENT DOCUMENTS

| | | |
|---|---|---|
| CA | 2429449 A1 | 11/2004 |
| KR | 2006013179 | 2/2006 |
| KR | 2010106123 | 10/2010 |

*Primary Examiner* — Steven B McAllister
*Assistant Examiner* — Allen R Schult
(74) *Attorney, Agent, or Firm* — Bartony & Associates LLC

(57) ABSTRACT

A barrier device to prevent insects from entering an opening of a vent in fluid connection with an interior of a building includes a body which includes a housing. The housing includes a first end adapted to be placed in fluid connection with the vent opening and a second end. The barrier device further includes a mesh barrier positioned adjacent the second end, opposite the first end, through which fluid (gas and liquid) can pass. However, insects of a predetermined range of size cannot pass through the mesh barrier. The mesh barrier has an effective open area at least as large as an open area of the opening of the vent.

20 Claims, 11 Drawing Sheets

(56) References Cited

U.S. PATENT DOCUMENTS

| | | | | |
|---|---|---|---|---|
| D462,436 | S | 9/2002 | Bennett | |
| 6,484,712 | B1 * | 11/2002 | Lyons | F23L 17/04 126/85 B |
| 6,735,790 | B1 * | 5/2004 | Willson | E03C 1/12 4/218 |
| 6,746,324 | B2 | 6/2004 | Achen | |
| 6,875,102 | B2 | 4/2005 | Achen | |
| 6,893,339 | B1 | 5/2005 | Berger | |
| 6,959,457 | B2 | 11/2005 | Hernandez | |
| 6,997,800 | B1 | 2/2006 | Kohler | |
| 7,022,010 | B1 | 4/2006 | Cardon | |
| 7,195,053 | B2 | 3/2007 | Pylkki | |
| D655,792 | S | 3/2012 | Teixeira | |
| 8,209,923 | B1 | 7/2012 | Rich | |
| D677,376 | S | 3/2013 | Wolff | |
| 8,574,045 | B2 | 11/2013 | Warner | |
| D698,434 | S | 1/2014 | Wolff | |
| 2001/0032352 | A1 | 10/2001 | Downey | |
| 2002/0123305 | A1 | 9/2002 | Tocher | |
| 2004/0148883 | A1 | 8/2004 | Lutz | |
| 2007/0157531 | A1 * | 7/2007 | Whitaker | A01M 1/24 52/101 |
| 2008/0271726 | A1 | 11/2008 | Jacklich | |
| 2009/0253366 | A1 | 10/2009 | Brown | |
| 2010/0086358 | A1 | 4/2010 | Haryslak | |
| 2010/0120352 | A1 | 5/2010 | Lynch | |
| 2011/0275307 | A1 | 11/2011 | Mciver | |
| 2012/0028564 | A1 | 2/2012 | Kelly | |
| 2012/0258656 | A1 | 10/2012 | Raimondi | |
| 2014/0194053 | A1 * | 7/2014 | Carroll | F24F 13/20 454/367 |
| 2015/0031282 | A1 | 1/2015 | Nagan | |
| 2015/0276248 | A1 * | 10/2015 | Bailey | F24F 13/22 454/356 |

* cited by examiner

INSECT BARRIERS FOR INLETS AND VENTS

CROSS-REFERENCE TO RELATED APPLICATIONS

This application is a continuation application of U.S. patent application Ser. No. 16/577,064, filed Sep. 20, 2019, which is a continuation application of U.S. patent application Ser. No. 14/738,059, filed Jun. 12, 2015, which claims benefit of U.S. Provisional Patent Application Ser. No. 62/011,772, filed Jun. 13, 2014, the disclosures of which are incorporated herein by reference.

BACKGROUND

The following information is provided to assist the reader in understanding technologies disclosed below and the environment in which such technologies may typically be used. The terms used herein are not intended to be limited to any particular narrow interpretation unless clearly stated otherwise in this document. References set forth herein may facilitate understanding of the technologies or the background thereof. The disclosure of all references cited herein are incorporated by reference.

Insect infestations can be a mere nuisance or can create health problems. Moreover, infestations of sufficient number of insects can cause malfunction of various types of systems or machinery. Recently, the non-indigenous *halyomorpha halys*, also known as the brown marmorated stink bug, or simply the stink bug, has been causing considerable problems in the United States. The stink bug, which is an insect in the family pentatomidae, is native to Asia (China, Korea, Japan and Taiwan) and was accidentally introduced into the United States. The stink bug is considered to be an agricultural pest.

SUMMARY

In one aspect, a barrier device to prevent insects from entering an opening of a vent in fluid connection with an interior of a building includes a body which includes a housing. The housing includes a first end adapted to be placed in fluid connection with the vent opening and a second end. The barrier device further includes a mesh barrier positioned adjacent the second end, opposite the first end, through which fluid (gas and liquid) can pass. However, insects of a predetermined range of size cannot pass through the mesh barrier. The mesh barrier has an effective open area at least as large as an open area of the opening of the vent. The effective open area of the mesh assembly is at least 120% of the open area of the opening of the vent, at least 150% of the open area of the opening of the vent, at least 200% of the open area of the opening of the vent. Unlike currently available vent capping or barrier devices, the barrier devices hereof do not inhibit flow of, for example, vent gas therethrough. The housing may, for example, be formed from a generally rigid material.

In another aspect, a barrier system to prevent insects from entering an outlet of one of a plurality of vents includes a body. The body includes a generally rigid housing having a first end adapted to be placed in fluid connection with an outlet of a first of the plurality of vents. The first of the plurality of vents has a first configuration suitable to form a cooperative connection with the first end of the rigid housing. The barrier system further includes a second end opposite the first end and a mesh barrier positioned adjacent the second end. Fluids can pass through the mesh barrier, but insects of a predetermined range of size cannot pass therethrough. The barrier system also includes an adapter section having a first end adapted to be placed in connection with the first end of the housing and a second end adapted to be placed in connection with an outlet of a second of the plurality of vents. The second of the plurality of vents has a second configuration, which is different from the first configuration, and suitable to form a cooperative connection with the second end of the adaptor.

In a number of embodiments, the first end of the body is adapted to form a friction fit with the outlet of the first of the plurality of vents which has a first outer diameter and the second end of the adapter section is adapted to form a friction fit with the outlet of the second of the plurality of vents which has a second outer diameter, which is different from the first diameter. In a number of embodiments, the first end of the body is adapted to form a friction fit with the outlet of the first of the plurality of vents which has a first inner diameter of 2 inches and the second end of the adapter section is adapted to form a friction fit with the outlet of the second of the plurality of vents which has an inner diameter of a 2-inches female coupler, elbow or adapter. The body may, for example, be formed from PVC, and the adapter section may, for example, be formed from PVC. In a number of embodiments, no tools are required to place the body in fluid connection with the outlet of any one of the plurality of vents.

In another aspect, a barrier device to prevent insects from entering an opening of a vent in fluid connection with an interior of a building, includes a body having a rigid, generally cylindrical housing. The housing has a first end adapted to be placed in fluid connection with the vent opening and a second end, opposite the first end. The barrier device further includes a mesh barrier positioned adjacent the second end, opposite the first end, through which fluid can pass, but insects of a predetermined range of size cannot pass. The housing further includes a plurality of passages extending radially through the housing through which liquid can pass via gravity flow to exit the housing. A number of the plurality of passages are positioned at different positions around the circumference of the housing so that the housing can be rotated about an axis of the housing over a range of positions when the axis of the housing is oriented generally horizontally and at least one of the plurality of passages is generally aligned the orientation of gravity. In that regard, in a number of embodiment, at least one of the plurality of passages may, for example, have an opening that is positioned within 10 degrees or even 5 degrees of the orientation of gravity over the range of positions. In a number of embodiments, the range of positions is between 30 and 360 degrees (for example, 30, 45, 90, 180, 270 or even 360 degrees). In that regard, the plurality of passages may be positioned around the circumference of the housing so that the housing can be rotate about the axis of the housing to any position (that is, 360 degrees about the axis) when the axis of the housing is oriented generally horizontally and at least one of the plurality of passages is generally aligned the orientation of gravity.

In a number of embodiments, the barrier device includes a mesh assembly including at least one ring member and the mesh barrier in operative connection with the ring member. An outer wall of the ring member forms a connection with the inner wall of the housing. The ring member includes a plurality of passage formed in the outer wall thereof via which liquid can flow to exit the housing. A number of the plurality of passages formed in the outer wall of the ring member are positioned at different positions around the circumference of the ring member so that the ring member can be rotated about an axis of the ring member over a range of positions when the axis of the ring member is oriented generally horizontally and at least one of the plurality of passages is generally aligned with the orientation of gravity (as described above for the plurality of passages from in the housing).

In another aspect, a barrier device to prevent insects from entering an opening of a vent in fluid connection with an interior of a building includes a body including a housing. The housing includes a first end adapted to be placed in fluid connection with the vent opening and a second end, opposite the first end. The barrier device further includes a mesh assembly positioned adjacent the second end through which fluid can pass, but insects of a predetermined range of size cannot pass. The mesh assembly includes a mesh barrier and a first ring rearward of the mesh barrier. The first ring includes an outer wall which forms a friction fit connection with an inner wall of the housing. The mesh assembly further includes a second ring forward of the mesh barrier which includes an outer wall which forms a friction fit with an inner wall of the housing. The barrier device further includes at least one removable connector which cooperates with the housing and the mesh assembly to releasably attached the mesh assembly to the housing. The at least one removable connector may, for example, be a fastener such as a screw which passes through the housing to form a connection with the first ring.

In a further aspect, a barrier device to prevent insects from entering an opening of a vent in fluid connection with an interior of a building includes a body including a housing having a first end adapted to be placed in fluid connection with the vent opening and a second end, opposite the first end. The barrier device further includes a mesh barrier positioned adjacent the second end through which fluid can pass, but insects of a predetermined range of size cannot pass. The mesh barrier includes a mesh having an insect repellent or insect killer thereon.

The present devices, systems, and methods, along with the attributes and attendant advantages thereof, will best be appreciated and understood in view of the following detailed description taken in conjunction with the accompanying drawings.

DETAILED DESCRIPTION

Figure 1A:
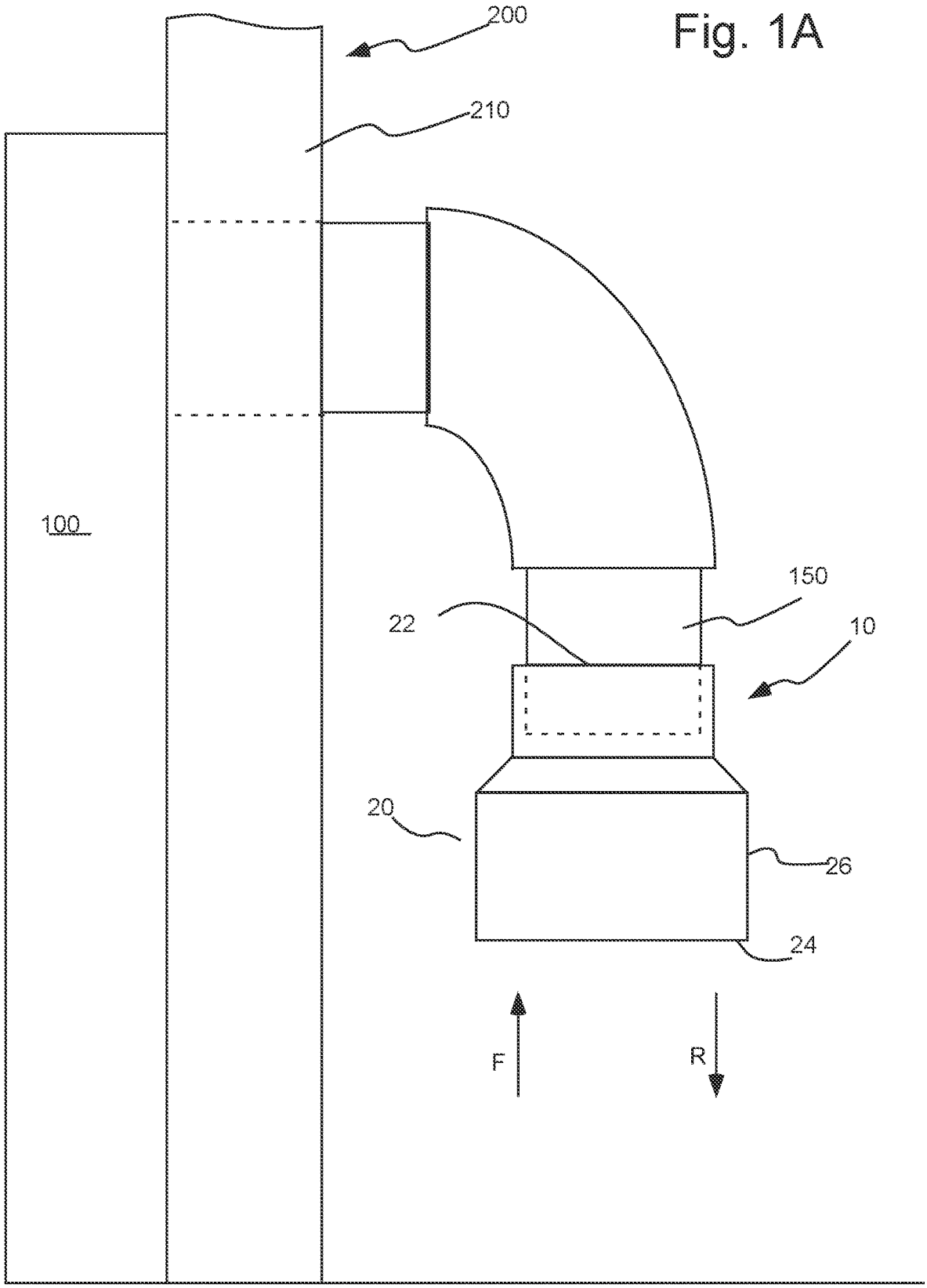
FIG. 1A illustrates an embodiment of a device hereof attached to a vent wherein the plane of the outlet of vent is oriented generally horizontally and the axis of the device is oriented generally vertically.

It will be readily understood that the components of the embodiments, as generally described and illustrated in the figures herein, may be arranged and designed in a wide variety of different configurations in addition to the described example embodiments. Thus, the following more detailed description of the example embodiments, as represented in the figures, is not intended to limit the scope of the embodiments, as claimed, but is merely representative of example embodiments.

Reference throughout this specification to "one embodiment" or "an embodiment" (or the like) means that a particular feature, structure, or characteristic described in connection with the embodiment is included in at least one embodiment. Thus, the appearance of the phrases "in one embodiment" or "in an embodiment" or the like in various places throughout this specification are not necessarily all referring to the same embodiment.

Furthermore, described aspects (including, for example, those set forth in the Summary), features, structures, or characteristics may be combined in any suitable manner in one or more embodiments. In the following description, numerous specific details are provided to give a thorough understanding of embodiments. One skilled in the relevant art will recognize, however, that the various embodiments can be practiced without one or more of the specific details, or with other methods, components, materials, et cetera. In other instances, well known structures, materials, or operations are not shown or described in detail to avoid obfuscation.

As used herein and in the appended claims, the singular forms "a," "an", and "the" include plural references unless the context clearly dictates otherwise. Thus, for example, reference to "a mesh" includes a plurality of such meshes and equivalents thereof known to those skilled in the art, and so forth, and reference to "the mesh" is a reference to one or more such meshes and equivalents thereof known to those skilled in the art, and so forth. Recitation of ranges of values herein are merely intended to serve as a shorthand method of referring individually to each separate value falling within the range. Unless otherwise indicated herein, and each separate value as well as intermediate ranges are incorporated into the specification as if it were individually recited herein. All methods described herein can be performed in any suitable order unless otherwise indicated herein or otherwise clearly contraindicated by the text.

Stink bugs and/or other insect species may, for example, enter into a heating, ventilation and air conditioning (HVAC) system of a building such as a home via air inlets, gas exhaust outlets, or vents, which place the HVAC system (for example, a gas furnace heating portion thereof) in fluid connection with the ambient environment. Inlets and outlets are sometimes referred to herein collectively as vents. Other system including such vents are also at risk. Although such vents may be part of a closed system such as a gas fired furnace, and thus do not provide a pathway into the building living space (that is, external to the gas furnace portion of the HVAC system), entrance of sufficient number of insects such as stink bugs into the system through such vents can cause malfunction or even complete failure of the system.

FIGS. 1A through 5C illustrate an embodiment of a device or system 10 hereof that is suitable to keep insects of a certain size, and particularly stink bugs, out of a vent 150 of an HVAC system 100 such as a high efficiency gas furnace system. In FIG. 1A, the plane of the outlet of vent 150 is oriented generally horizontally (and the axis A (see FIG. 1C) of device/system 10 oriented generally vertically) In FIG. 1B, the plane of the outlet of vent 150 is oriented generally vertically (and the axis A of device/system 10 is oriented generally horizontally). Inlet/Outlet or vent 150 passes through an exterior wall of a building 200 (for example, a house) to connect with gas furnace system 100 (illustrated schematically in FIG. 1). The size of device 10 can vary, but each differently sized device performs a similar function. In a number of embodiments, size was minimized to minimize materials used in fabrication and assembly.

Vents 150 are typically formed from 2-inch (that is, having a 2-inch inside diameter) PVC piping. When installed on the PVC vents 150 (for example, a fresh air inlet pipe and a gas exhaust pipe), devices 10 create a physical barrier on the outside open ends of both vents 150. Devices 10 then help to physically block all sizes of stink bugs from accessing and entering into system 100.

In the fall of each year, as the outside temperatures begin to turn colder, stink bugs will enter buildings such as homes through every crack and crevice through which they can pass. They also will enter through open vents such as PVC furnace vents 150. Once a few stink bugs enter, many more may follow. As described above, vents 150 are typically in fluid connection with a closed flow path system within a gas furnace system 100, and the insects will not be able to exit furnace system 100 to enter the living space inside a home. However, the insects will be present within furnace system 100. Should enough stink bugs enter into furnace system 100, they may, for example, clog one or more elements of the flow path thereof, causing damage to furnace system 100. Such damage may require expensive repairs or replacement of furnace system 100. Device 10 may prevent such damage. Preferably, device 10 is installed when furnace system 100 is new. Even when devices 10 are installed on existing or operating furnaces system, they will help keep all sized stink bugs out of the internal flow path of the gas furnace system from that time of installation forward.

In a number of embodiments, an effective open area or cross-sectional open area of a wire meshed inlet in device 10 is at least as large or larger than the open area or the open cross-sectional area of outlet 152 of vent 150. Devices 10 are connected to fresh air in and exhaust gas out vents 150 of furnace system 100 and thereby become a part of the flow path of furnace system 100. Carbon monoxide and carbon dioxide are also present in the exhaust of a gas furnace system 100. There should be no significant fresh air in or exhaust out flow restrictions caused by anything attached to the flow path of furnace system 100 (for obvious safety reasons). In a number of embodiments, an effective open area of a wire meshed assembly 30 of device 10 was 157% of the open area (or the cross-sectional area of the opening) of outlet 152 (see, for example, FIG. 1A) of vent 150 (or 57% larger than the open area of outlet 152). Device 10 was found to not measurably affect the normal operation of furnace system 100 after installation thereof.

In one study of a private furnace system 100, devices 10 were installed on inlet/outlet vents 150 of furnace system 100 for over 45 days with very cold (below freezing) outside ambient temperatures for a number of days/nights. With device 10 installed on outlet/exhaust vent 150 no freezing or ice inside device 10 was observed. IR Digital temperature readings inside the device were taken. When furnace system 100 was operating (or in an on state), the average measured temperature was 67° F. When furnace system 100 was not operating (or in an off state) between heating cycles, the average temperature was 36° F. No temperature readings were taken in the case of device 10 installed on air inlet vent 150, as only fresh ambient air was passing through into inlet vent 150. Devices 10 may thus be installed on, for example, furnace system vents year round (even with temperatures well below the freezing point of water) without adverse effects.

In the embodiment illustrated in FIGS. 1A through 5C, device or system 10 includes a body 20. In the illustrated embodiment, a first or rearward end 22 of body 20 is, for example, a 2-inch female end that may be used to connect to a commonly sized, 2-inch (inside diameter) furnace system male vent 150 (commonly referred to as 2-inch pipe). It is generally understood in the piping arts that a 2-inch female openings will fit over any 2-inch male pipe end (for example, via a readily releasable friction fit). This also applies to other sizes of pipes and couplers, elbows, adaptors, etc. Body 10 increases to a three inch female opening at its second or forward end 24. Second end 24 houses a mesh or screen assembly 30 which includes first or forward annular member or ring 32 and a second or rearward annular member or ring 34. In a number of embodiments, first ring 32 and second ring 34 were cut from a section of 3-inch PVC pipe. First ring 32 and second ring 34 have a outside diameter that is slightly less than the inner diameter of second end 24, which is a 3-inch female adaptor size. In a number of embodiments, body 10 was formed monolithically from polyvinylchloride or PVC in the form of a 2"-to-3" inch PVC adapter. First ring 32 and second ring 34 may, for example, be formed from short lengths of PVC piping suitable to mate with the female adaptor open end or second end 24 of body 20.

The 3-inch female second end 24 of body 20, which measures approximately 3 and ½ inches inside diameter, allows for mesh or screen assembly 30, which measures approximately 3 and ⅜ inch outer side diameter, to fit inside as described above. The cross-sectional area of the exposed portion (which is a circle with a diameter of 3 inches) was 7.06 $in^2$. In that regard, the area of a circle is $\pi r^2$ ($3.14*(1.5\ in)^2=7.06\ in^2$). The cross-sectional open area of a common 2-inch (that is 2-inch inside diameter) furnace vent 150 is 3.14 square inches ($3.14*(1.0\ in)^2=3.14\ in^2$). In a number of embodiments, wire mesh 36, captured between first ring 32 and second ring 34, in assembly 30 had a 70% open area which results in an effective open area of 4.94 $in^2$ (that is, 70% of 7.06 $in^2$), which is 157% the open area of the 2-inch pipe. In a number of embodiments, the effective open area of assembly 30 is at least 100%, at least 120%, at least 140% or at least 150% of the open area of vent 150 to which it is to be attached (via device 10). In a number of embodiments, the effective open area of assembly 30 (that is, the open area thereof as reduced by the projected area of mesh 36) is greater than the open area of vent 150. For example, the effective open area of assembly 30 may be at least 120%, at least 140% or even at least 150% of the open area of vent 150. As described above, device 10 should not pose any substantial flow restriction. Providing for an effective open area of assembly 30 that is greater than the open outlet area (that is, the cross-sectional area of the outlet opening) of vent 150 ensures that there will be no flow restriction even in the case that there is a partial blockage of assembly 30.

Device 10 may readily be manufactured or adapted to universal fit virtually any type and/or size of vent 150 (for example, varying in size from 2-6 inches or others sized vents). Device 10 may, for example, easily connect to, for example, any standard 2-inch male PVC pipe vent 150 or any other 2-inch female coupler, elbow or other 2-inch female vent 150. In that regard, an intermediate or adapter section 40 may be provided as part of device or system 10. Adapter section 40 includes a first or forward end 42 that mates (that is, forms a cooperating fluid connection) with first end 22 of body 20 (for example, via a readily releasable friction fit) and a second end 44 that mates with and connects to the outlet end of vent 150. In the illustrated embodiment, adapter section 40 is a length of 2-inch PVC pipe so that second end 44 mates (for example, via a readily releasable friction fit) with any 2-inch female coupling, elbow or other standard 2-inch female vent 150 (for example, including a length of PVC piping) having an outlet with an approximately 2-inch inner diameter (also commonly used in venting). As clear to one skilled in the art, second end 44 may be configured (for example, shaped and/or dimensioned) to form a cooperating fit with many different types of outlets of vents 150. In the illustrated embodiment as described above, second end 44 will mate with any standard 2-inch female vent 150. Should vent 150 be a 2-inch male PVC pipe, one can remove adapter section 40 from body 20 and mate the 2-inch female first end 22 of body 20 with the 2-inch male vent 150.

In a number of embodiments, device 10 connects to vents 150 without using tools. In that regard, such vents are typically formed using, for example, PVC piping of various diameters as described above. Forming device or system 20 such that each of first end 22 of body 20, first end 42 of adapter section 40, and second end 44 of adapter section 40, form a friction fit with, for example, PVC piping, enables removable attachment of device 20 (with or without the use of adapter section 40) to vents 150 without the use of tools. In that regard, a slight pushing/forward and twisting hand motion will install device 10 on such vents 150. Devices 10 can easily and readily be removed using a slight pulling/rearward and twisting hand motion. Thus, device 10 can thus be installed and removed using hands only, and without the use of tools.

Figure 1B:
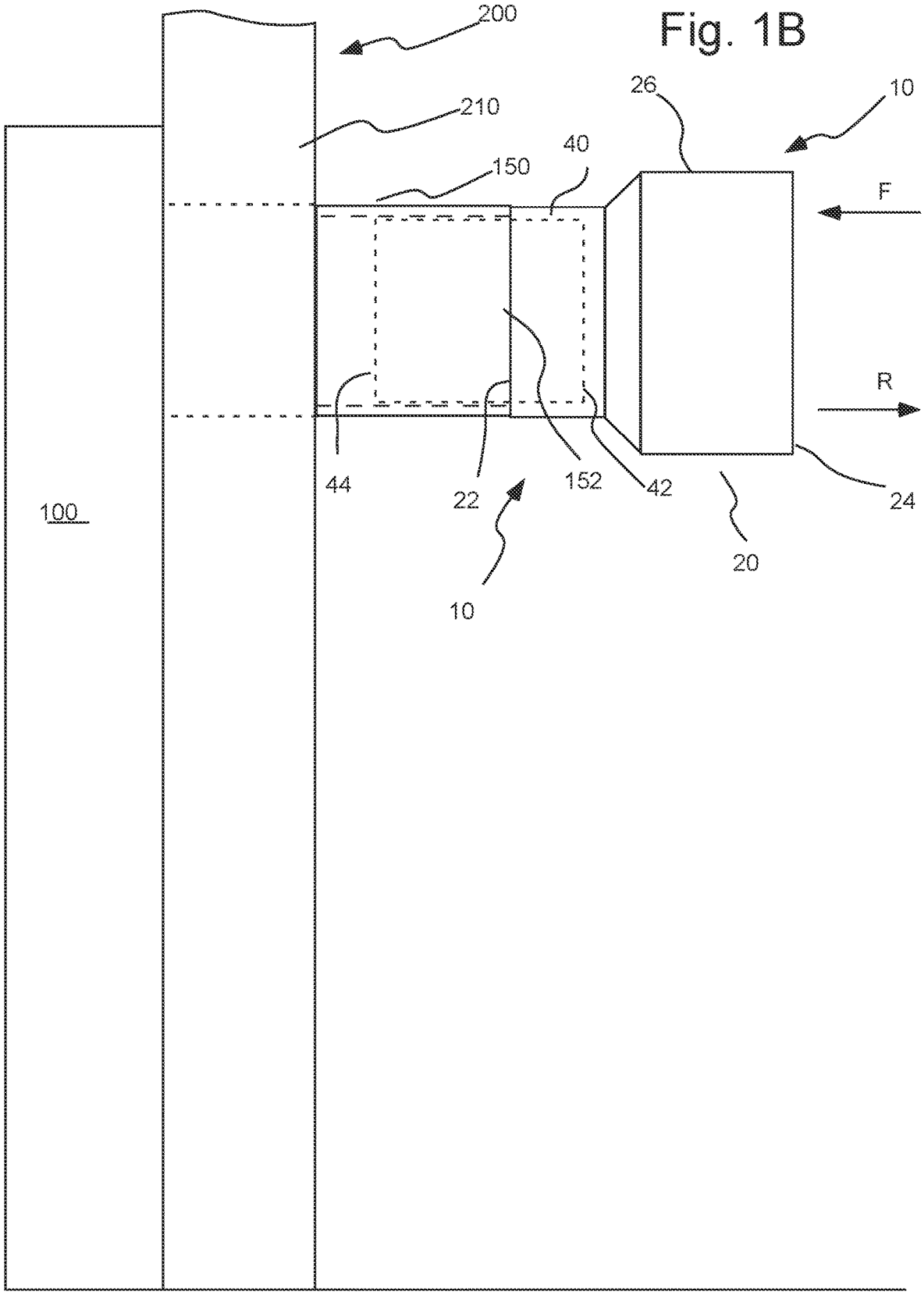
FIG. 1B illustrates the device of FIG. 1A attached to a vent wherein the plane of the outlet of vent is oriented generally vertically and the axis of the device is oriented generally horizontally.
Figure 1C:
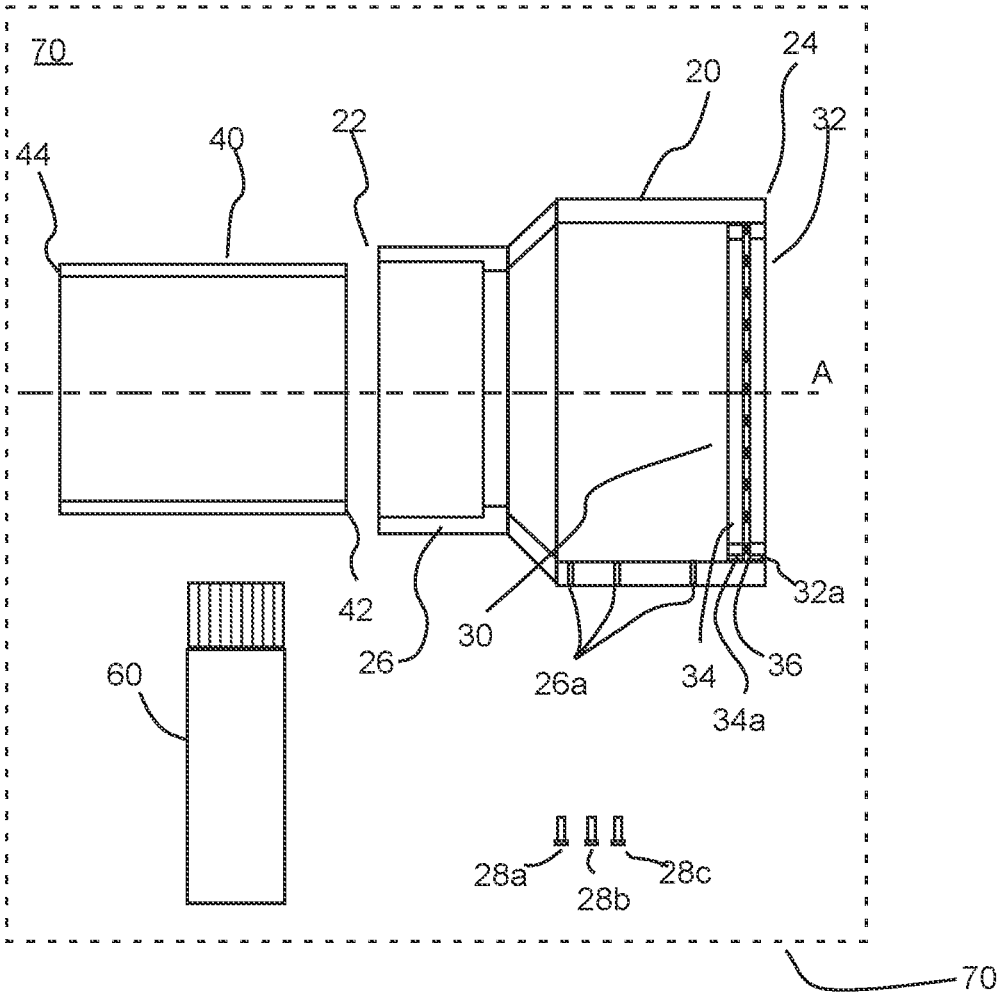
FIG. 1C illustrates a side, cutaway view of the device of FIG. 1A.
Figure 2:
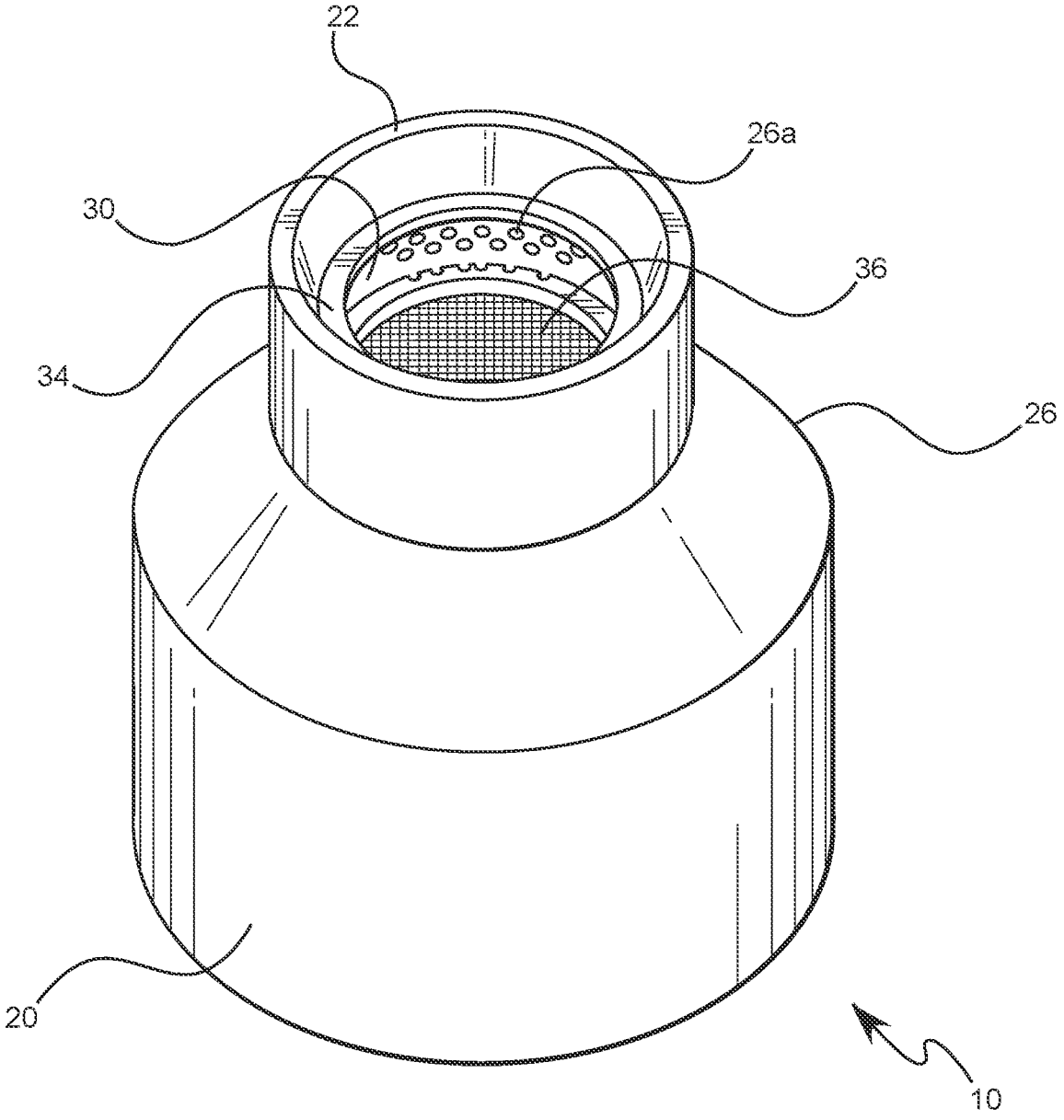
FIG. 2 illustrates a rear perspective view of the device of FIG. 1A with the adapter section removed from attachment with the body.

As used herein, "forward" and similar terms refer to a direction toward the outlet opening of vent 150, and "rearward" and similar terms refer to a direction away from the outlet opening of vent 150 (represented by arrows F and R, respectively, in FIGS. 1A and 1B). The term "axial" or "longitudinal" and similar terms refers to a forward or rearward direction generally parallel to an axis A (see, FIG. 1C) about which device 10 is formed (although not necessarily symmetrically thereabout). The terms "radial" or "latitudinal" and similar terms refers to a direction generally perpendicular to axis A.

Device 10 will help to keep stink bugs, other similarly sized insects, small birds, small rodents, including mice and even snakes out of system 100 when installed on the open outside ends of the fresh air intake and gas exhaust outlet vents 150. As most gas furnaces systems have each of an inlet vent 150 and an outlet vent 150 to the outside atmosphere, two devices 10 will be installed to protect system 100 in the case that system 100 is a gas furnace system. Although examples of device 10 are discussed herein for use in connection with vents 150 of a furnace system 100, devices 10 can be used in connection with any type of inlets, outlets or vents.

Figure 3A:
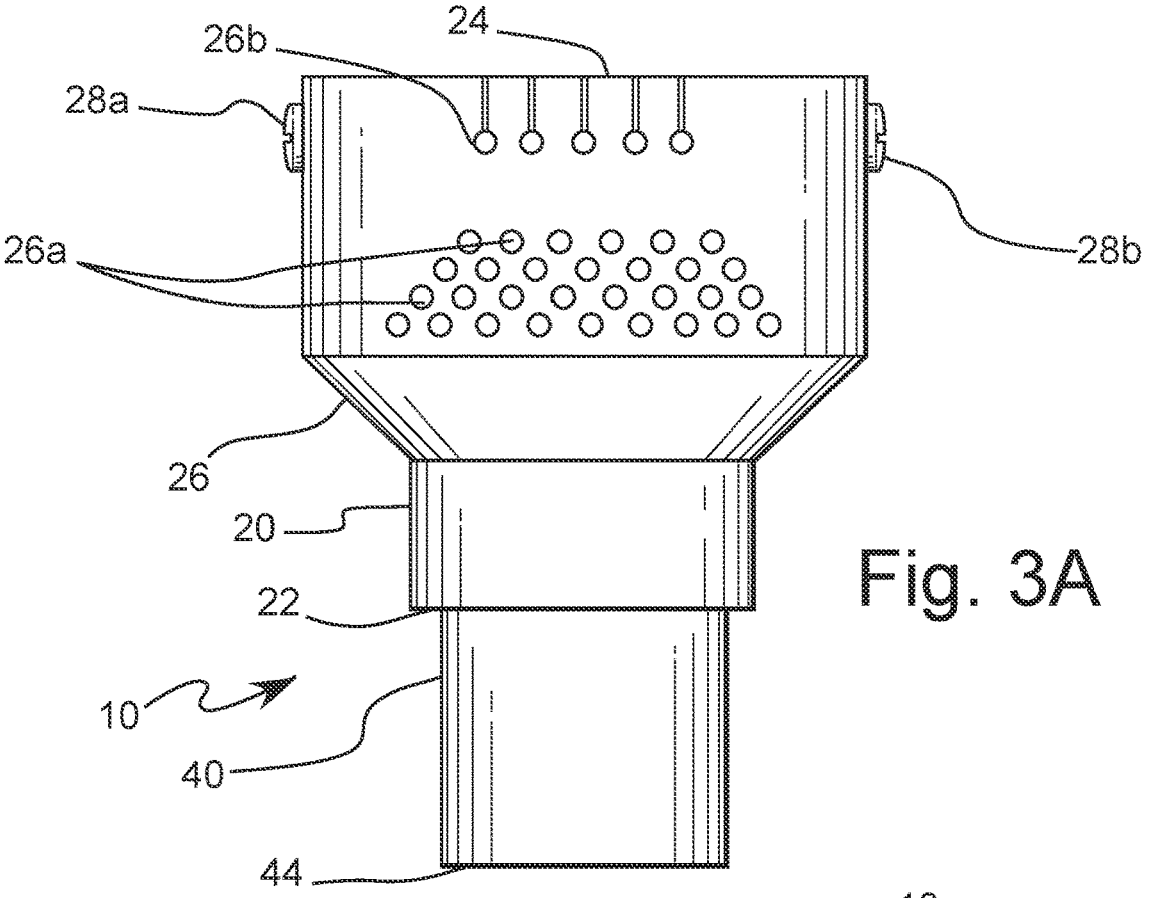
FIG. 3A illustrates a side perspective view of the device of FIG. 1A.
Figure 3B:
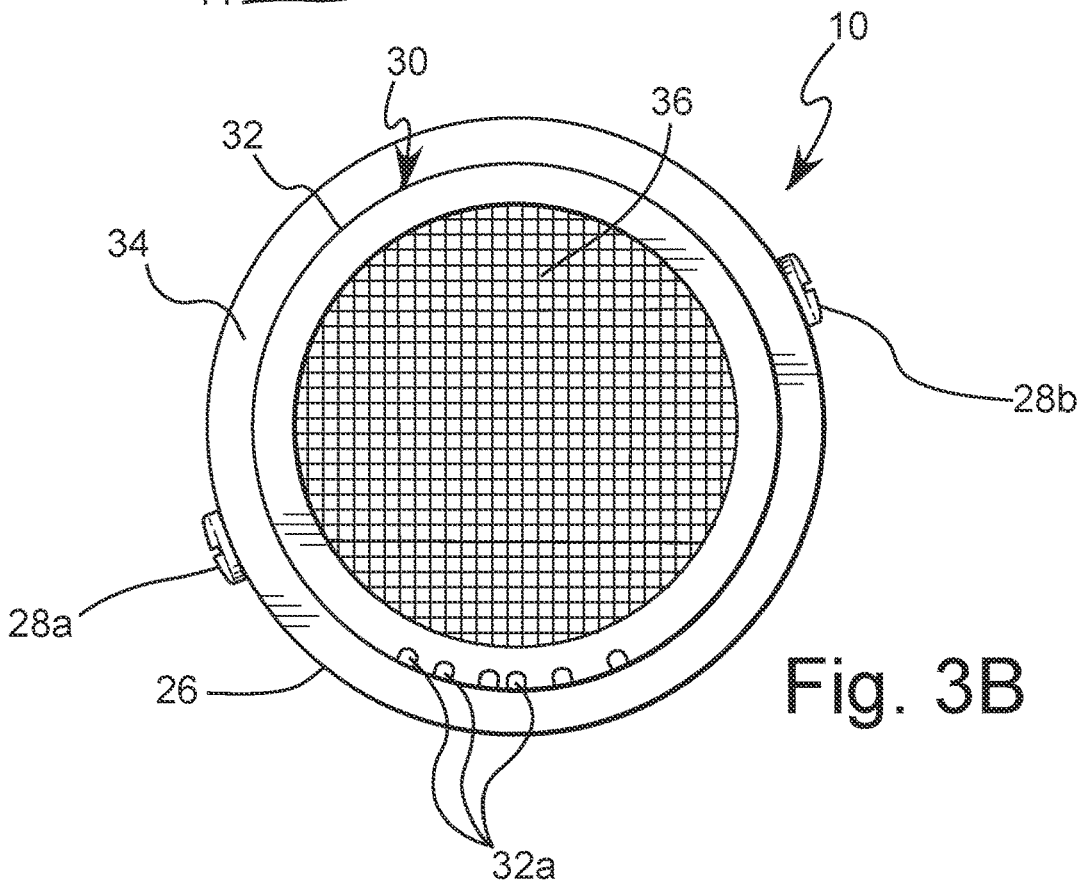
FIG. 3B illustrates a front view of the device of FIG. 1A.
Figure 4:
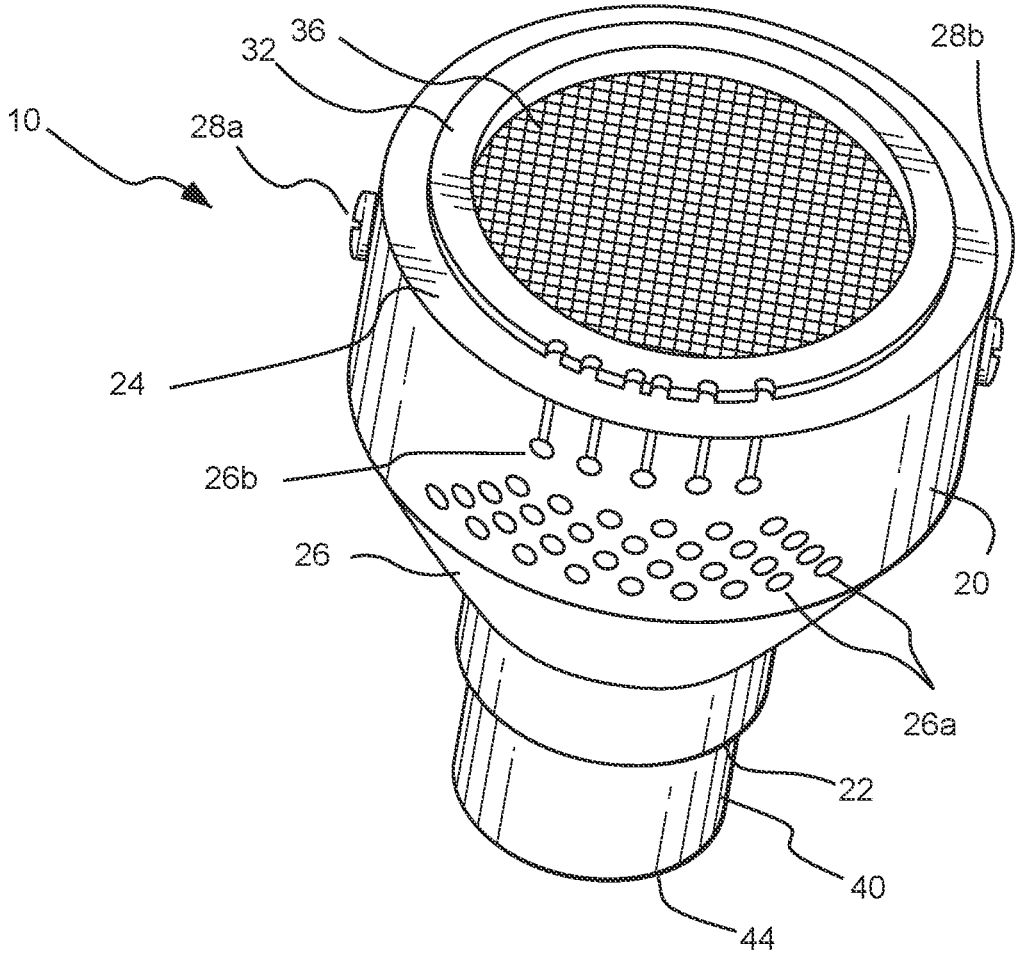
FIG. 4 illustrates a front perspective view of the device of FIG. 1A.
Figure 5A:
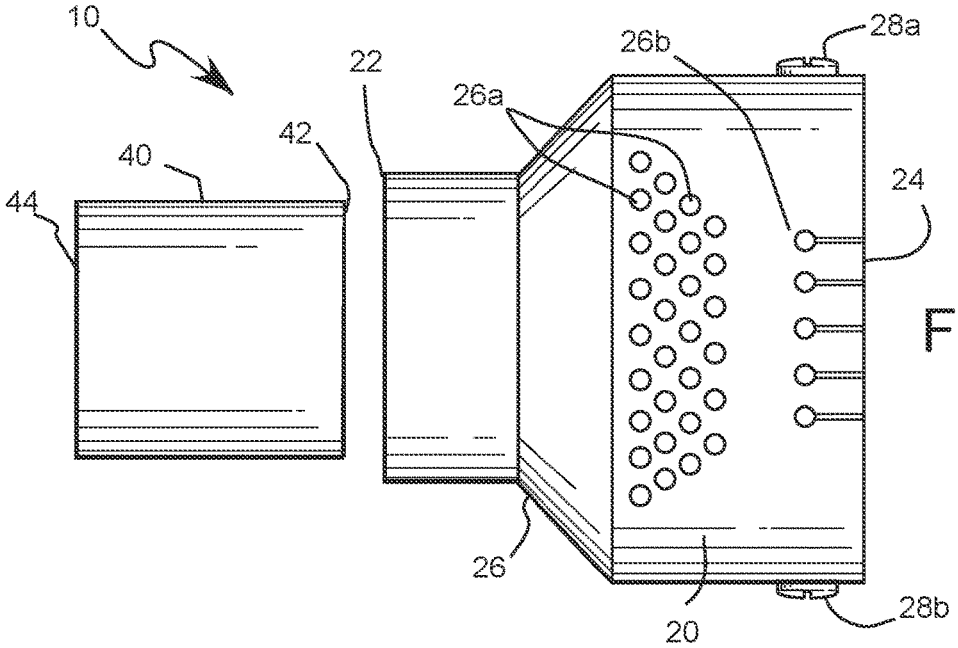
FIG. 5A illustrates a side perspective view of the device of FIG. 1A with an adapter thereof disconnected from the remainder of the device.
Figure 5B:
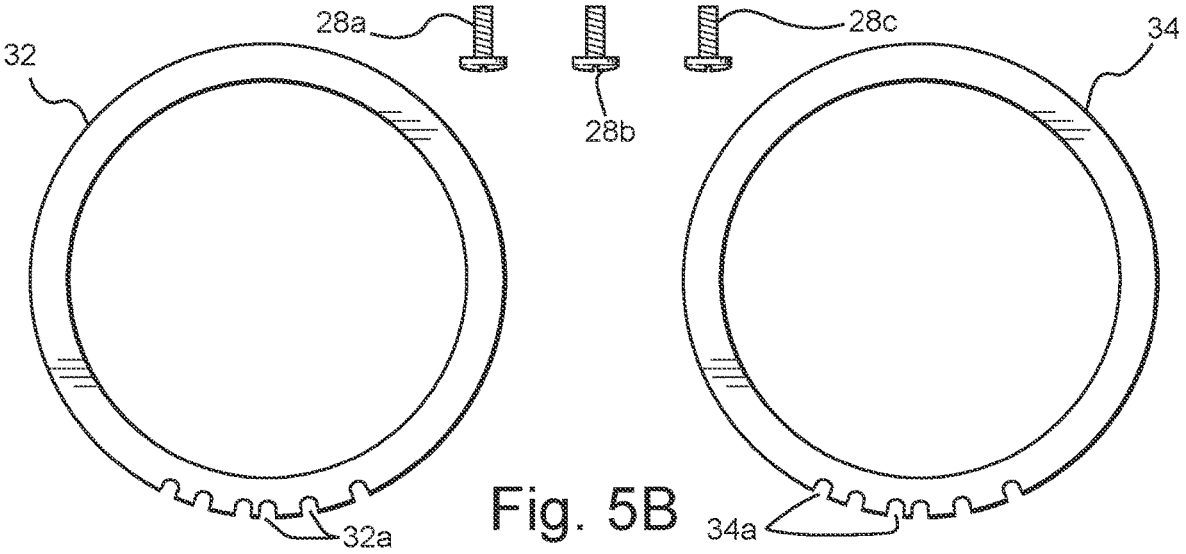
FIG. 5B illustrates connective rings and connectors used in the device of FIG. 1A.
Figure 5C:
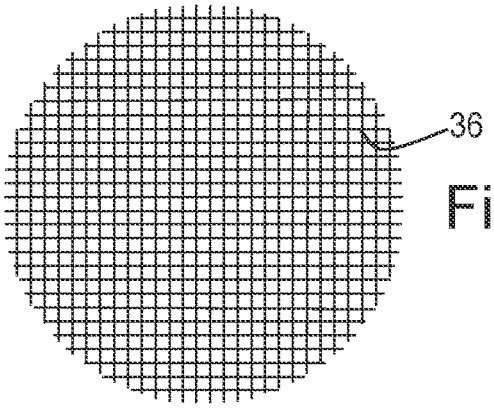
FIG. 5C illustrates a mesh or screen used in the device of FIG. 1A.

In a number of embodiments, body 20 of device 10 has a number of generally radially extending drain holes or passages 26*a* in a housing or outer wall 26 thereof. During installation, holes 26*a* may, for example, be oriented downward (toward the ground or in the direction of gravity; see FIGS. 1B and 1C) so that gravity will assist in drainage. In that regard, drain holes 26*a* provide an exit pathway to allow condensed moisture droplets from warm exhaust vapor formed inside body 20 of device 10 and on mesh assembly 30 to drain out of device 10. In a number of embodiments, axially extending passages, holes or grooves 32*a* and 34*a* are also formed in first ring 32 and second ring 34, respectively, so that condensed moisture may also pass through the radially outer ring portion of mesh assembly 30. Drain holes or passages 26*a*, 32*a* and 34*a* provide an open pathway for the moisture droplets to drain out of device 10. As illustrated in FIGS. 3A and 5A, a forward row of drain holes or passages 26*b*, may be provided which are in fluid connection with the space between first ring 32 and second ring 34 to assist in allowing moisture droplets moving down off mesh assembly 30 to exit the device 10.

On a cold winter day, one can see a warm, moist steam cloud coming out of a furnace exhaust vent 150, when furnace system 100 is operating during a heating cycle. When, for example, natural gas burns (combustion) the result is carbon dioxide, water, and a great deal of energy, plus smaller amounts of other by products of combustion. The water is usually evaporated during the reaction to give off steam. As this warm exhaust steam passes through device 10, some of it cools and condenses on the inner surface of housing 26 of device 10 and on mesh assembly 30. Drain holes or passages 26*a*, 26*b*, 32*a* and 34*a* may be sized to be large enough to allow the moisture droplets to drain out of the device, but small enough to keep stink bugs and similarly sized insects from entering into device 10. In a number of embodiments, holes or passage 26*a*, 32*a* and 34*a* had a diameter of approximately ⅛ inch or less. Larger or other sized and/or shaped drain holes may be used for this application. Fewer or more holes or passages 26*a*, 32*a* and 24*a* that illustrated may be provided. In a number of embodiments, holes or passages 26*a*, 32*a* and 34*a* extend around the entire circumference of housing 26, first ring 32 and/or second ring 34, respectively, to provide for drainage regardless of orientation of device 10.

Figure 6C:
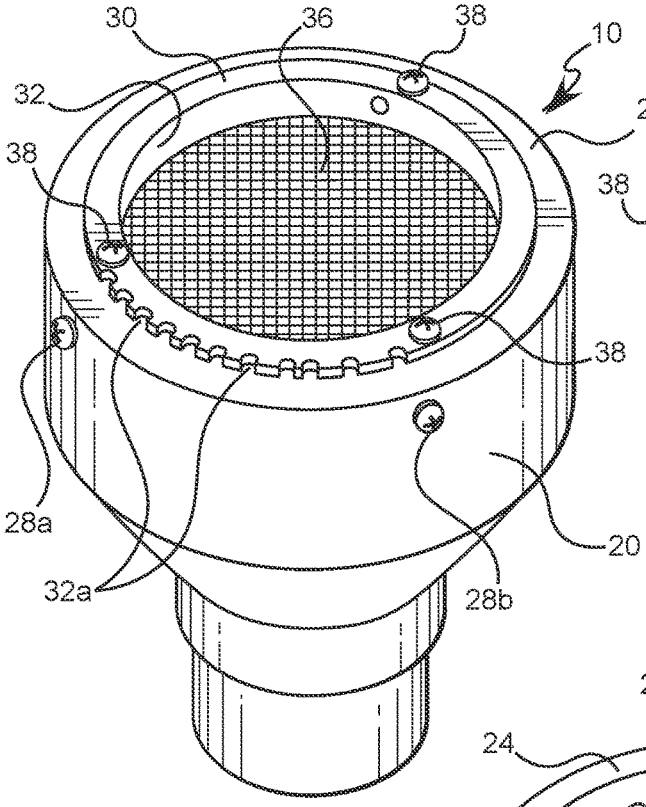
FIG. 6C illustrates a perspective view of the device of FIG. 6B in an assembled state.
Figure 6A:
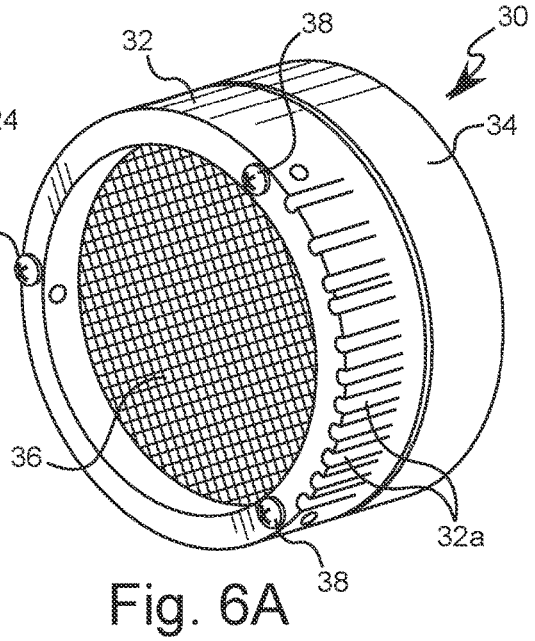
FIG. 6A illustrates a perspective view an embodiment of a a mesh assembly hereof which is formed as an integral assembly which is removable from the device as an integral unit.
Figure 6B:
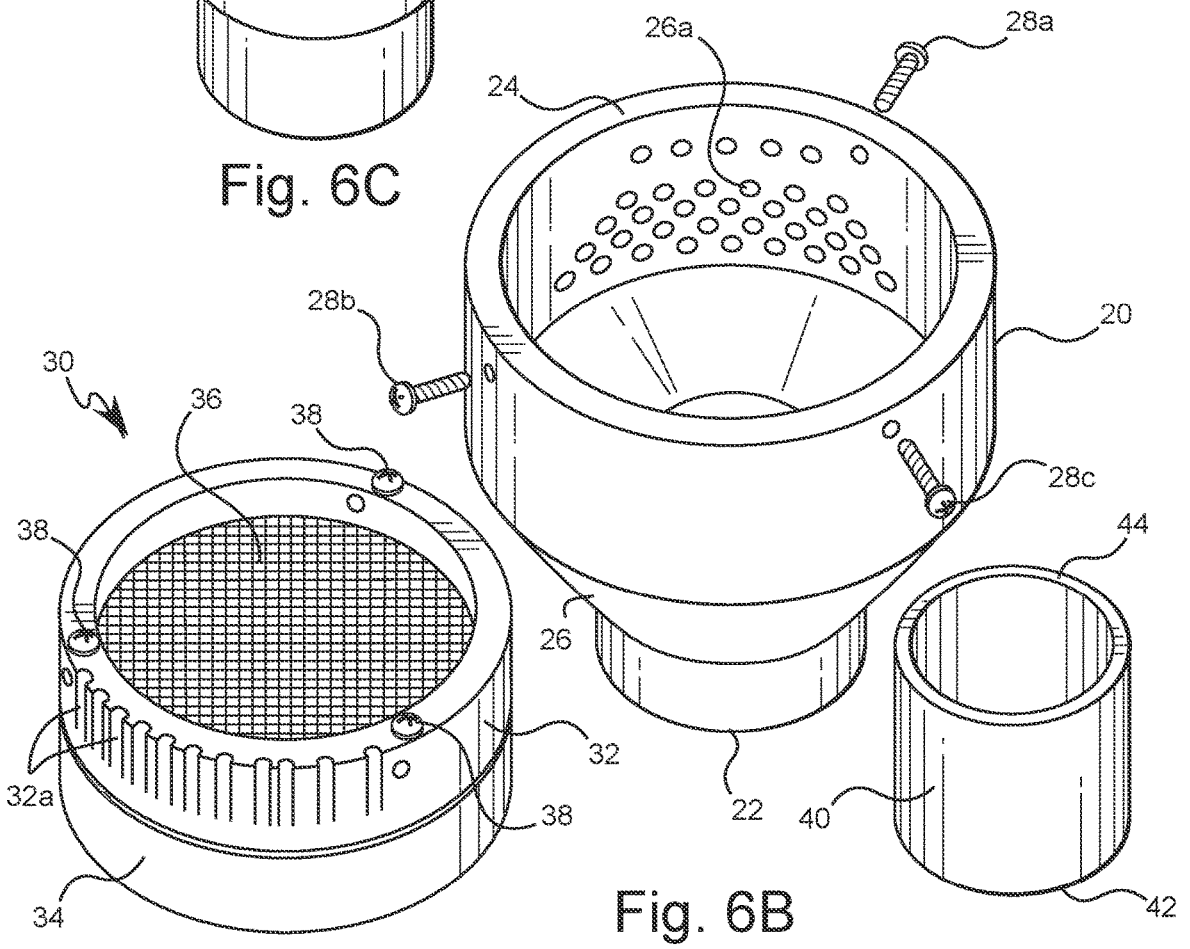
FIG. 6B illustrates perspective view of a device including the integral mesh assembly of FIG. 6A in a disassembled state.

In a number of embodiments, mesh barrier assembly 30 of device 10 can easily be accessed and removed for cleaning or replacement as needed. As illustrated in FIGS. 6A through 6C, first ring 32 and second ring 34 may be connected via, for example, connectors such as screws 38 so that mesh barrier assembly 30 may be removed and/or installed as an integral unit or assembly. In a number of embodiments, forward or first ring 32 was an approximately ⅜ inch to ½ inch long (axially extending) section of 3-inch inside diameter PVC pipe (suitable to form a friction fit with the 3-inch female second end 24 of body 20), which was attached to housing 26 via three small screws or other connectors (for example, three #6½" stainless steel screws 28*a-c*) which secure the first ring 32 to housing 26 of body 20. In a number of embodiments, first ring 34 was pushed inside body 20 first, forming a tight hand-pressed, friction fit. Next, the wire mesh 30 was pushed inside body 20. Then, second ring 32 was pushed inside body 20. Three evenly spaced holes were the drilled through housing/wall 26 of body 20 and into first ring 32, but not all the way through first ring 32. Screws 28*a*, 28*b* and 28*c* were then installed into the drilled holes. In general, first ring 32 and second ring 34 should form an abutting connection with the inner wall of housing 26 such that the insects desired to be excluded from device 10 cannot pass thereby. Once connectors 28*a-c* and first ring 32 are removed, mesh or screen barrier 36 can easily be removed. In a number of embodiments, rearward of second ring 34 was a ½ inch long (axially extending) section of 3-inch inside diameter PVC pipe which holds mesh barrier 36 in place within body 20. Mesh barrier assembly 30 components may, for example, be also joined together using glue or contact adhesive to effectively become an integral, permanently connected assembly. Mesh assembly 30, may, for example, be installed within body 20 and then joined together with body 20 using a glue or adhesive.

In a number of embodiments, mesh barrier 30 was formed by cutting a 3 and ⅜" circular shaped piece of ⅛" galvanized wire mesh. In other embodiments, a stainless steel 8 mesh, 0.020 wire diameter, wire mesh barrier 36 was used. Mesh 30 could also be made from brass, bronze, copper, nickel, silver, aluminum or other wire mesh metals and materials. Mesh barrier 30 may also be formed of polymeric material (for example, PVC) using, for example, an injection molding process. For example, mesh barrier 36 may be made from a nylon line in a crossing matrix mesh assembly. For example, an annular ring similar to ring 32 and mesh 36 may be formed monolithically in an injection molding process. In a number of embodiments, a mesh barrier 36 having approx.⅛ in. square openings provided good performance, as it allowed the exhaust gases to pass therethrough without restriction, while also creating a suitable physical barrier to keep stink bugs and similarly sized insects out of device 10 (and thereby out system 100). In a number of embodiments, mesh 30 has opening no greater than ¼ inch or no greater than ⅛ inch. The mesh openings may be larger in size as suitable for a particular application. The openings in the mesh may, for example, be square, circular and/or many other shapes.

A stainless steel mesh barrier 30 or a polymeric mesh barrier 30 may, for example, be used to provide increased resistance to rust and corrosion, particularly if device 10 is to be installed for a year round installation, including the cold months when furnace system 100 will be operating to heat building 200. A galvanized wire mesh barrier may, for example, be used if device 10 is to be installed on a seasonal basis (for example, in the warmer months when furnace system 100 is typically not operating, but insects are active in the outside environment). In a seasonal cycle, devices 10 may, for example, be installed in northern climates at the same time a homeowner installs window screens for the spring, summer and fall of the year (that is, when furnace system is not operating or operating on a limited basis). Devices 10 may be uninstalled or removed when the window screens are removed for late fall, winter and early spring months (when furnace system 100 is operating a significant percentage of the time and insects are not active in the outside environment).

In a number of embodiments, mesh barrier 36 (or all of assembly 30) may, for example, be treated with an insect repellant and/or killer in, for example, a chemical dip tank process. In such a process, mesh barrier 36 (or assembly 30) may, for example, be submerged in a chemical dip tank and drip dried before being installed into body 20. Device 10 would then offer both a physical and a chemical barrier to stink bugs and similarly sized insects. Also or alternatively, a container or bottle 60 (see FIG. 1C) of an insect repellent/killer can be provided with an installation kit 70 (which may, for example, be provided in packaging 72) for initial and/or additional treatments as needed. For example, a relatively small (for example, a 2-4 ounce) spray bottle of St Gabriel Organics Stink Bug Killer available from St. Gabriel Organics of Orange, Va. US may be provided.

Figure 7A:
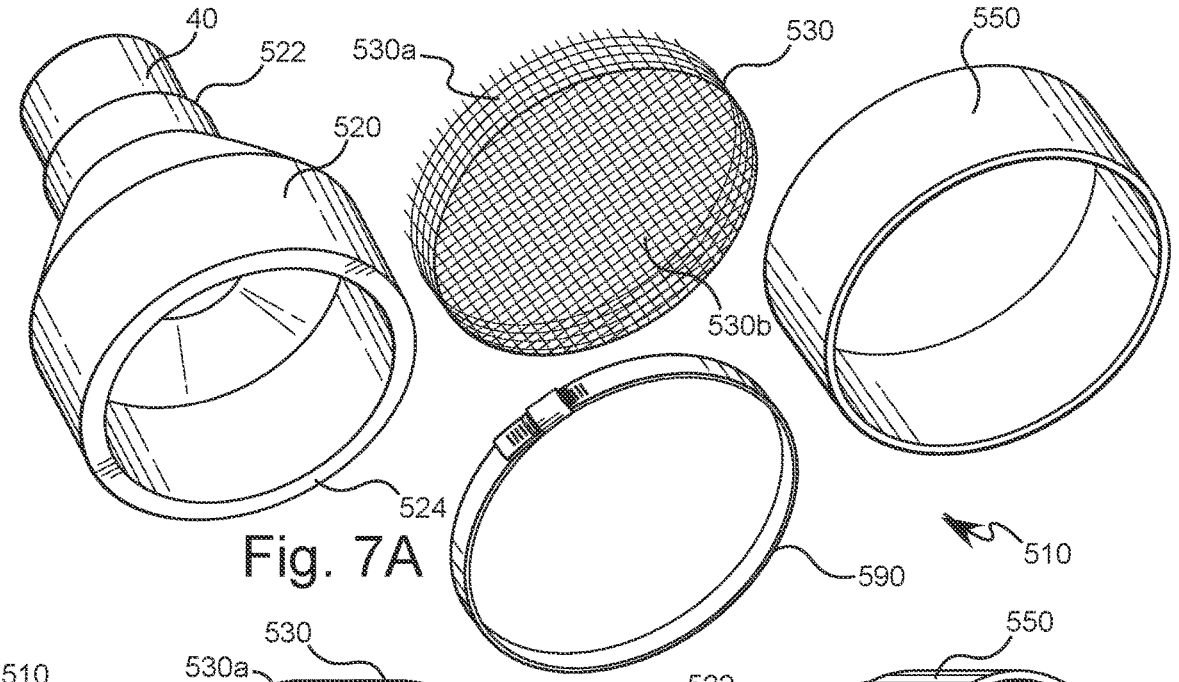
FIG. 7A illustrates components of alternative embodiments of devices hereof in a disassembled state.
Figure 7B:
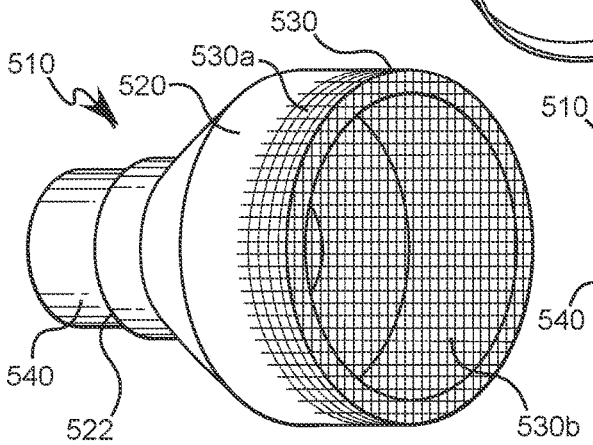
FIG. 7B illustrates one embodiment of a device hereof with a mesh member formed generally in the shape of a cylinder which is open on one end placed over the end a body of a device hereof.
Figure 7D:
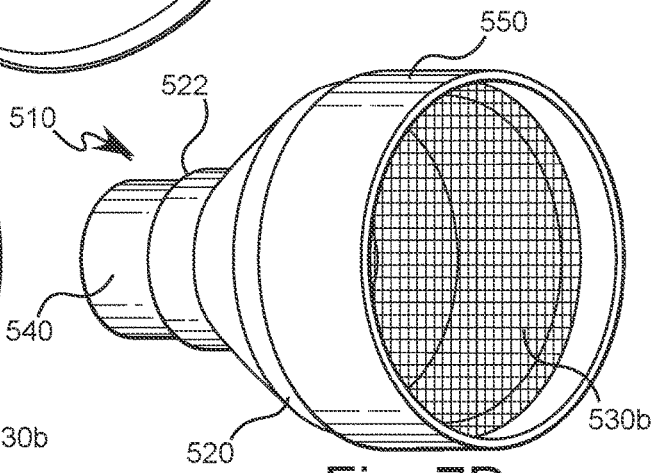
FIG. 7D illustrates securement of the mesh assembly of FIG. 7B with a generally cylindrical collar that slides over the axially extending portion of the mesh assembly and the body of the device.
Figure 7C:
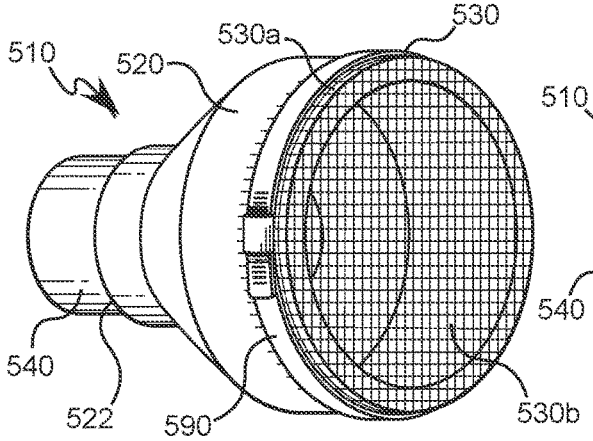
FIG. 7C illustrates the securement of the mesh member of FIG. 7B with a hose clamp to complete the assembly of the device hereof.
Figure 7E:
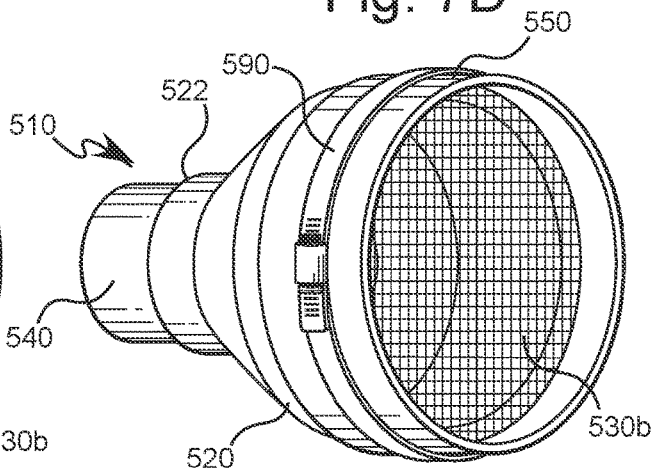
FIG. 7E illustrates further securement of the device of FIG. 7D using a hose claim around the generally cylindrical collar.

FIG. 7A through 7C illustrate two similar alternative embodiments of a device 510 hereof. FIG. 7A illustrates components of alternative embodiments of device 510 in a disassembled state. Similar to device 110, device 510 include a body 520 and an adapter section 540 which are identical to body 20 and adapter section 40 of device 10. Unlike device 10, however, device 510 includes a mesh member or barrier 530 formed generally in the shape of a cylinder which is open on one end placed over the end a body of a device hereof. Mesh member 530 includes a generally axially extending portion 530*a* and a generally radially extending portion 530*b*. As, for example, illustrated in FIG. 5B, mesh member 520 is place over a forward end 524 of body 520 so that radially extending portion 530*b* abuts forward end 524 and axially extending portion 530*a* encompasses the wall of body 520. In a first embodiment of device 510, as illustrated in FIG. 7C, a retainer such as a hose clamp 590 is place around axial extending portion 530*a* of mesh member 520 and tightened to removably retain and secure mesh member 530 in operative connection with body 520. In a second embodiment, as illustrated in FIGS. 7D and 7E, a generally cylindrical collar or sleeve 550 (for example, a 4-inch diameter section of plastic piping having a length of approximately 1.5 inches) is slid over the axially extending portion of the mesh assembly and over body 520 to secure mesh member 530. As illustrated in FIG. 7E, an appropriately sized hose clamp 590 may be used to encompass sleeve 550 to provide additional security. Using a mesh with an open area of 70%, the open area of device 520 (wherein body 520 was formed from a 2 to 3 inch adapter coupler) was 214% that of a 2-inch furnace vent 150.

Figure 8:
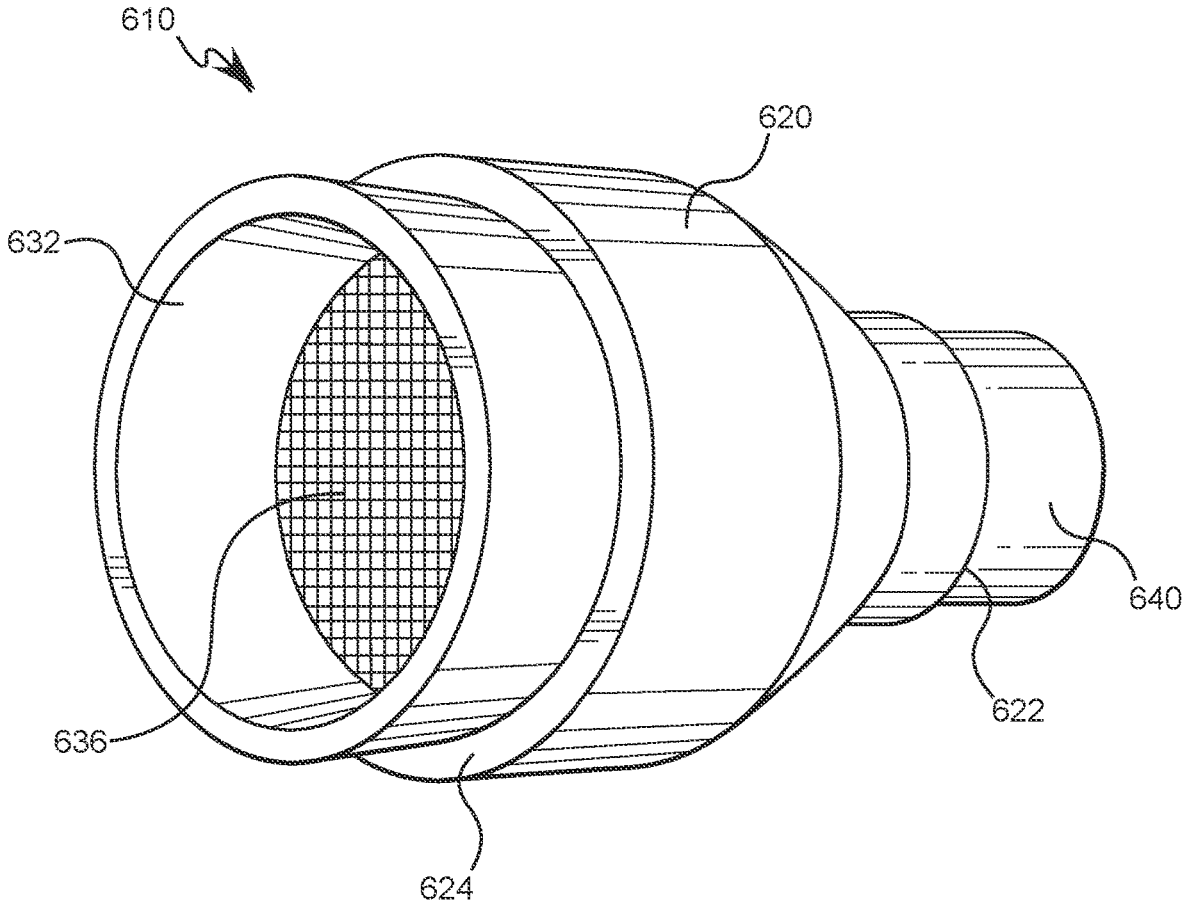
FIG. 8 illustrates a perspective view of another embodiment of a device hereof in which a mesh member is held in place at the end of the body via a friction fitting ring or annular member.

In the embodiment of device 610 of FIG. 8, the methodology of installing and/or securing mesh barrier 636 within body 620 is somewhat different than in the above-described embodiments. During installation of mesh barrier 636, body 620 may, for example, be first stood upon on its first or rearward end 622 on a solid surface. A section of screen or mesh which forms mesh barrier 636, may, for example, be cut from a roll, as square piece of mesh material. The section of mesh or mesh barrier 636 is laid across second or forward end 624 of body 620. An annular member or ring 632 (having an outer diameter slightly less than the inner diameter of second end 624) is then placed over mesh barrier 636 and aligned with opening of second end 624 of body 620. Ring 632 is then forced down into second end 624 of body 620, pushing mesh barrier 636 along in front of it. Ring 632 and mesh barrier 636 may, for example, be forced into body 620 using a heavy duty rubber mallet. Excess material of mesh 636 sticking out from the area between ring 632 and body 620 may be trimmed.

Figure 9A:
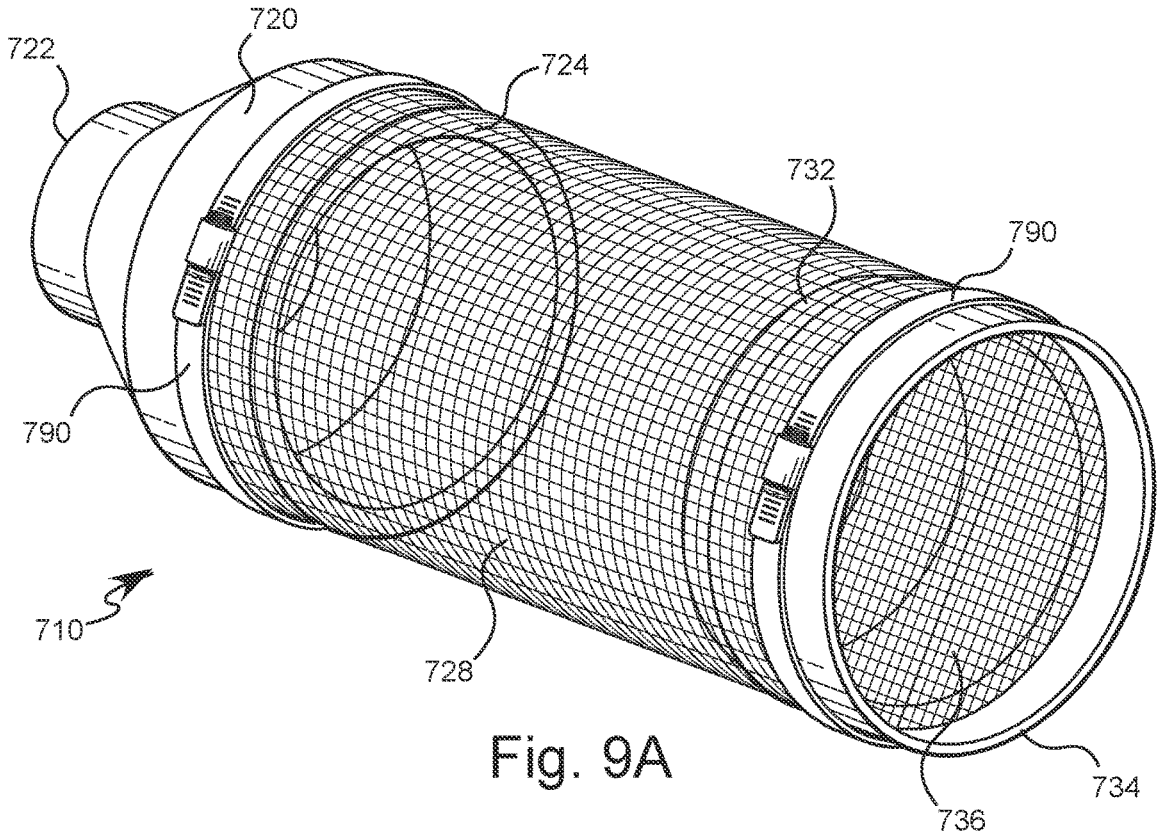
FIG. 9A illustrates a perspective view of another embodiment of a device hereof including an axially extending mesh member connecting the body and an end mesh assembly.
Figure 9B:
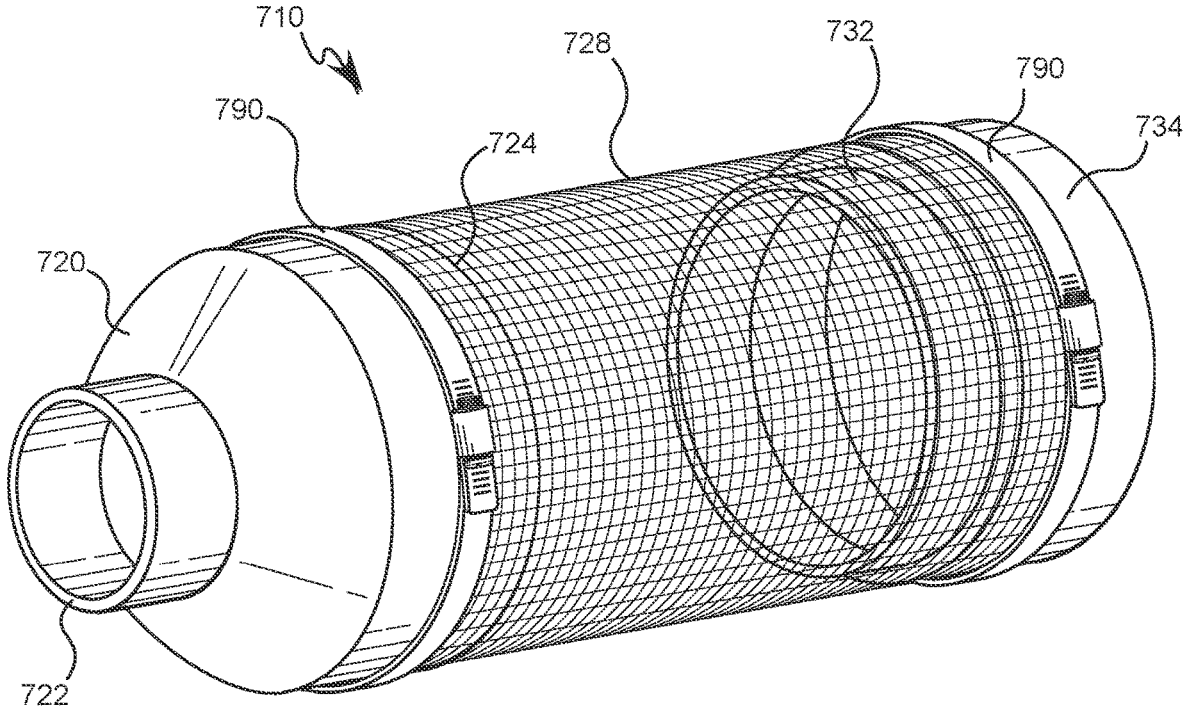
FIG. 9B illustrates another perspective view of the device of FIG. 9A.

FIGS. 9A and 9B illustrate another embodiment of a device 710 hereof. In the embodiment of device 710, an axially extending, generally cylindrical member is form from a mesh or screen material as described above for mesh barriers 36 and 636. Extending mesh member 728 extends from a body 720 which may, for example, be similar to or identical to bodies 20, 520 and 620 described above. An adapter section, similar to or identical to adapter sections 40, 540 and 640 may be used, but is not shown in FIGS. 9A and 9B. A mesh assembly 730 may, for example, be formed in a manner similar to the incorporation of mesh 636 into device 610. For example, a section 734 of a 3 inch female coupler and a section 732 of 3 inch pipe can be used in mesh assembly 730. A mesh or screen member or barrier 736 may be placed between section 732 and section 734 and section 732 may be forced into section 734 to secure mesh barrier 736 therebetween. In that regard, mesh member 736 becomes sandwiched between sections 732 and 734 as described above for mesh barrier 736. Extending mesh member 728 may, for example, be formed by rolled a section of wire or mesh screen (which can, for example, have the same mesh size as mesh barrier 736) into a generally cylindrical shape (in several embodiments, extending mesh member 728 was about 5 inches long). In the illustrated embodiment, extending mesh member 728 is attached to body 720 and mesh assembly 736 using appropriately sized hose clamps 790. Also, generally cylindrical collar or sleeve 750 (formed, for example, from polymeric material such as polyvinylchloride) may be used as described above in connection with sleeves 550. Like other devices hereof, device 710 provides an effective open area many times larger than the open area of the vent to which it is attached. The effective open area can be readily increased through appropriate choice of components as described herein. Device 710 also provide for drainage therefrom regardless of orientation about the axis of device 710. As with all devices hereof, device 710 can be formed (or adapted) to fit and attach to many differently sized vents or vent pipes (for example, 2 inch, 3 inch, 4 inch, 6 inch or any other size, as needed).

In the embodiments described herein, device 10 may be readily and inexpensively formed from readily available components including, for example, PVC piping, connectors or adapters and wire mesh. Device 10 is readily place in removably connection with a variety of common vents 150 via, for example, a removable friction fits between piping sections. Device 10 may, for example, be readily installed and removed without the use of tool via such friction fits.

The foregoing description and accompanying drawings set forth a number of representative embodiments at the present time. Various modifications, additions and alternative designs will, of course, become apparent to those skilled in the art in light of the foregoing teachings without departing from the scope hereof, which is indicated by the following claims rather than by the foregoing description. All changes and variations that fall within the meaning and range of equivalency of the claims are to be embraced within their scope.

What is claimed is:

1. A kit, comprising:

one or more barrier devices to prevent insects from entering a closed combustion flow path system within a gas furnace system located within an interior of a building via a vent including a pipe extending exterior to the building, an exterior extending end of the pipe including an opening in fluid connection with the closed combustion flow path system, each of the one or more barrier devices comprising:

a. a body comprising a housing, the housing comprising a forward end section to form a mating, friction fit either with (i) the exterior extending end of the pipe at one end of the forward end section or with (ii) an adapter which forms a friction fit with the exterior extending end of the pipe, the forward end section being connected to an intermediate section which increases in cross-sectional area along its length at another end of the forward end section, a rearward end section attached to the intermediate section opposite the forward end section and having an opening therein which has an area greater than an area of the opening of the pipe, the rearward end section further comprising a plurality of passages extending radially through the housing through which liquid can pass via gravity flow to exit the housing, a number of the plurality of passages being positioned at different positions around the rearward end section of the housing so that the rearward end section of the housing can be rotated about an axis thereof over a range of positions, at least one of the plurality of passages is generally aligned to provide gravity flow therethrough when the axis of the rearward end section is oriented generally horizontally, and b. a mesh barrier attached to the housing at a position forward of a rearward end of the body to form a barrier between the opening in the rearward end section and an outside environment, the mesh barrier comprising a plurality of openings no greater than ¼ inch wide through which fluid can pass, but insects of a predetermined range of size cannot pass, the mesh barrier having an effective open area at least 100% of an open area of the opening of the pipe so that there is no substantial flow restriction between an environment outside the barrier device and the closed combustion flow path system.

2. The kit of claim 1 wherein the housing is formed of a rigid material.

3. The kit of claim 2 wherein the forward end section is generally cylindrical and the intermediate section is generally frustoconical.

4. The kit of claim 2 wherein the effective open area is at least 120% of the open area of the opening of the pipe.

5. The kit of claim 2 wherein the effective open area is at least 150% of the open area of the opening of the pipe.

6. The kit of claim 2 wherein the effective open area is at least 200% of the open area of the opening of the pipe.

7. The kit of claim 3 wherein the body is formed from polyvinylchloride.

8. The kit of claim 1 wherein the plurality of openings in the mesh barrier are no greater than ⅛ inch wide.

9. The kit of claim 2 wherein the forward end is adapted to form a friction fit with an exterior extending end of a pipe having a first outer diameter and a forward end of the adapter is adapted to form a friction fit with an exterior extending end of a pipe having a second outer diameter, which is different from the first outer diameter.

10. The kit of claim 9 further comprising the adapter.

11. The kit of claim 10 wherein the body is formed from polyvinylchloride and the adapter is formed from polyvinylchloride.

12. The kit of claim 2 wherein no tools are required to place the body in fluid connection with the exterior extending end of the pipe.

13. The kit of claim 11 wherein the rearward end section in generally cylindrical and the plurality of passages are positioned around a circumference of the rearward end section so that the rearward end section can be rotated about the axis thereof to any position when the axis of the rearward end section is oriented generally horizontally and at least one of the plurality of passages is aligned to provide gravity flow therethrough.

14. The kit of claim 2 further comprising a mesh assembly comprising a first annular member and the mesh barrier, which is in operative connection with the first annular member, an outer wall of the first annular member forming a connection with the inner wall of the rearward end section, which is generally cylindrical.

15. The kit of claim 14 wherein the mesh assembly further comprises a second annular member, the first annular member being positioned rearward of the mesh barrier and the second annular member being positioned forward of the mesh barrier, an outer wall of the second annular member forming a connection with the inner wall of the rearward end section.

16. The kit of claim 15 wherein the outer wall of the first annular member forms a friction fit connection with the inner wall of the rearward end section, and the outer wall of the second annular member forms a friction fit with the inner wall of the rearward end section.

17. The kit of claim 16 wherein the barrier device further comprises at least one removable connector which cooperates with the rearward end section and the mesh assembly to releasably attached the mesh assembly to the housing.

18. A kit of claim 2 wherein the mesh barrier comprises an insect repellent or insect killer thereon.

19. The kit of claim 2 further comprising at least a second barrier device.

20. A method of preventing insects from entering a closed combustion flow path system within a gas furnace system located within an interior of a building via a vent including a pipe extending exterior to the building, an exterior extending end of the pipe including an opening in fluid connection with the closed combustion flow path system, comprising: providing a kit including one or more barrier devices, each of the one or more barrier devices including:

a. a body comprising a housing, the housing comprising a forward end section to form a mating, friction fit either with (i) the exterior extending end of the pipe at one end of the forward end section or with (ii) an adapter which forms a friction fit with the exterior extending end of the pipe, the forward end section being connected to an intermediate section which increases in cross-sectional area along its length at another end of the rearward end section, a rearward end section attached to the intermediate section opposite the forward end section and having an opening therein which has an area greater than an area of the opening of the pipe, the rearward end section further comprising a plurality of passages extending radially through the housing through which liquid can pass via gravity flow to exit the housing, a number of the plurality of passages being positioned at different positions around the rearward end section of the housing so that the rearward end section of the housing can be rotated about an axis thereof over a range of positions, at least one of the plurality of passages is generally aligned to provide gravity flow therethrough when the axis of the rearward end section is oriented generally horizontally, and b. a mesh barrier attached to the housing at a position forward of a rearward end of the body to form a barrier between the opening in the rearward end section and an outside environment, the mesh barrier comprising a plurality of openings no greater than ¼ inch wide through which fluid can pass, but insects of a predetermined range of size cannot pass, the mesh barrier having an effective open area at least 100% of an open area of the opening of the pipe so that there is no substantial flow restriction between an environment outside the barrier device and the closed flow path system.

* * * * *